US009212487B2

(12) United States Patent
Kiik et al.

(10) Patent No.: US 9,212,487 B2
(45) Date of Patent: Dec. 15, 2015

(54) ENHANCED SINGLE LAYER ROOFING MATERIAL

(75) Inventors: Matti Kiik, Richardson, TX (US); Larry Scott Reed, Midlothian, TX (US); John Richie McCaskill, Jr., McKinney, TX (US); Michael Allen McLintock, Grapevine, TX (US); Michael L. Bryson, Independence, MO (US); Daniel Coleman DeJarnette, Tuscaloosa, AL (US); Michael Scott Kirk, Tuscaloosa, AL (US)

(73) Assignee: Elk Premium Building Products, Inc., Dallas, TX (US)

( * ) Notice: Subject to any disclaimer, the term of this patent is extended or adjusted under 35 U.S.C. 154(b) by 1333 days.

(21) Appl. No.: 11/237,023

(22) Filed: Sep. 28, 2005

(65) Prior Publication Data

US 2007/0068108 A1 Mar. 29, 2007

(51) Int. Cl.
*E04D 1/26* (2006.01)
*E04D 1/00* (2006.01)

(52) U.S. Cl.
CPC ..... *E04D 1/26* (2013.01); *E04D 2001/005* (2013.01)

(58) Field of Classification Search
USPC ..... 52/518, 554, 557
See application file for complete search history.

(56) References Cited

U.S. PATENT DOCUMENTS

| | | | |
|---|---|---|---|
| D102 | S | 8/1846 | Rickerby |
| 19,880 | A | 4/1858 | Smith |
| D2,297 | S | 5/1866 | Clark et al. |
| 121,063 | A | 11/1871 | Pierce |
| 126,547 | A | 5/1872 | Hickcox |
| 188,447 | A | 3/1877 | Walton |
| D15,359 | S | 8/1884 | Strover |
| 315,061 | A | 4/1885 | Perkins |
| 335,342 | A | 2/1886 | Daugherty |
| D20,695 | S | 4/1891 | Frand |

(Continued)

FOREIGN PATENT DOCUMENTS

| | | |
|---|---|---|
| CA | 0963626 | 3/1975 |

OTHER PUBLICATIONS

Eighteen photographs of shingles as a result of several focus group surveys on a wide variety of shingles, conducted by BJS III Marketing of Duncanville, Texas.

(Continued)

*Primary Examiner* — Joshua J Michener
(74) *Attorney, Agent, or Firm* — Fitzpatrick, Cella, Harper & Scinto

(57) ABSTRACT

A single layer roofing material having a headlap portion and a tab portion wherein the headlap portion has a color-value gradient or gradation and the tab portion has tabs and openings. The tabs may have a relatively uniform color. Openings between tabs expose the color gradient of the headlap portion when a first sheet of the roofing material is installed over a second sheet on a structure. A plurality of horizontal striations may be used to establish the desired color-value gradient. An illusion of depth or thickness is created when the roofing material is applied to a structure, such as a roof deck. The amount of tone and contrast may be selected to create the desired illusion of depth or thickness. The amount of contrast may be varied depending upon the color selected for each roofing material. The number of horizontal striations and their width may also be varied to provide the desired color-value gradient. Tab color, shape and size may also be varied to enhance the illusion of depth.

14 Claims, 8 Drawing Sheets

(56) References Cited

U.S. PATENT DOCUMENTS

| | | | |
|---|---|---|---|
| 553,514 | A | 1/1896 | Crawford |
| 614,478 | A | 11/1898 | Johnston |
| D35,195 | S | 10/1901 | Barrett |
| D35,592 | S | 1/1902 | Murdock |
| 716,585 | A | 12/1902 | Schneider |
| 748,141 | A | 12/1903 | Zwerk |
| D38,931 | S | 12/1907 | Dickelman |
| 876,098 | A | 1/1908 | Savery |
| 891,501 | A | 6/1908 | Overbury |
| D39,890 | S | 3/1909 | Pedlar |
| 957,623 | A | 5/1910 | Oesterheld |
| 978,333 | A | 12/1910 | Overbury |
| D41,353 | S | 5/1911 | Vogan |
| D42,101 | S | 1/1912 | Annis |
| D45,836 | S | 5/1914 | Goldberg |
| 1,096,267 | A | 5/1914 | Sammis |
| 1,108,236 | A | 8/1914 | Reynolds |
| 1,115,866 | A | 11/1914 | Reynolds |
| 1,150,298 | A | 8/1915 | Overbury |
| 1,154,334 | A | 9/1915 | Overbury |
| 1,157,665 | A | 10/1915 | Becker |
| D48,172 | S | 11/1915 | Dunlany |
| 1,208,595 | A | 12/1916 | McKay |
| 1,219,652 | A | 3/1917 | McKay |
| D51,438 | S | 10/1917 | Caron |
| 1,256,384 | A | 2/1918 | Simonson |
| D52,538 | S | 10/1918 | Lords |
| D53,015 | S | 2/1919 | Overbury et al. |
| 1,295,360 | A | 2/1919 | Overbury |
| D53,086 | S | 3/1919 | Overbury |
| D53,087 | S | 3/1919 | Overbury |
| D53,102 | S | 3/1919 | Creighton |
| D53,103 | S | 3/1919 | Creighton |
| 1,318,238 | A | 10/1919 | Speer |
| D54,160 | S | 11/1919 | Woodruff |
| D54,917 | S | 4/1920 | Heppes |
| 1,345,627 | A | 7/1920 | Overbury |
| D56,106 | S | 8/1920 | Russell |
| 1,351,181 | A | 8/1920 | McKay |
| 1,368,947 | A | 2/1921 | Levis |
| D57,865 | S | 5/1921 | Scharwath |
| D57,866 | S | 5/1921 | Scharwath |
| 1,379,368 | A | 5/1921 | Speer |
| 1,389,979 | A | 9/1921 | Rahr et al. |
| 1,410,867 | A | 3/1922 | Abraham |
| 1,414,778 | A | 5/1922 | Elvidge |
| D61,363 | S | 8/1922 | Butterick |
| 1,425,564 | A | 8/1922 | Whiteside |
| 1,431,103 | A | 10/1922 | Donahue |
| 1,434,332 | A | 10/1922 | Elvidge |
| 1,442,614 | A | 1/1923 | Hooker |
| 1,443,774 | A | 1/1923 | Weber |
| 1,450,731 | A | 4/1923 | Maclean |
| 1,464,492 | A | 8/1923 | Busha |
| 1,464,493 | A | 8/1923 | Busha |
| 1,464,494 | A | 8/1923 | Busha |
| 1,466,077 | A | 8/1923 | Wardell |
| 1,467,779 | A | 9/1923 | Dremann |
| 1,472,270 | A | 10/1923 | Harshberger |
| 1,483,046 | A | 2/1924 | Ritter |
| 1,494,788 | A | 5/1924 | Kromenaker et al. |
| 1,494,789 | A | 5/1924 | Abraham |
| 1,495,070 | A | 5/1924 | Finley |
| 1,496,108 | A | 6/1924 | Wilson et al. |
| 1,508,365 | A | 9/1924 | Lukens, Jr. et al. |
| 1,516,243 | A | 11/1924 | Perry |
| 1,518,857 | A | 12/1924 | Layton |
| 1,533,969 | A | 4/1925 | Busha |
| D67,565 | S | 6/1925 | Abbey et al. |
| 1,544,956 | A | 7/1925 | Torbert |
| 1,555,441 | A | 9/1925 | Sjodahl |
| D68,522 | S | 10/1925 | Dohm |
| D68,552 | S | 10/1925 | Sjodahl |
| 1,582,281 | A | 4/1926 | Kridler et al. |
| 1,584,023 | A | 5/1926 | Fischer |
| D70,986 | S | 8/1926 | Sjodhal |
| D70,987 | S | 8/1926 | Sjodahl |
| D70,988 | S | 8/1926 | Sjodahl |
| D70,989 | S | 8/1926 | Sjodahl |
| 1,601,731 | A | 10/1926 | Flood |
| 1,604,339 | A | 10/1926 | Cumfer |
| 1,604,708 | A | 10/1926 | Mills, Jr. |
| 1,604,745 | A | 10/1926 | Finley |
| 1,627,665 | A | 5/1927 | Overbury |
| 1,629,146 | A | 5/1927 | Busha |
| 1,629,287 | A | 5/1927 | Milligan |
| 1,631,936 | A | 6/1927 | Ritter |
| 1,633,474 | A | 6/1927 | Busha |
| 1,638,746 | A | 8/1927 | Robinson |
| 1,642,148 | A | 9/1927 | Guy |
| 1,648,692 | A | 11/1927 | McCarthy |
| 1,650,285 | A | 11/1927 | Lindley |
| 1,612,776 | A | 12/1927 | Kirschbraun |
| 1,655,885 | A | 1/1928 | Adair |
| 1,657,271 | A | 1/1928 | Nelson |
| D74,467 | S | 2/1928 | Abraham |
| D74,669 | S | 3/1928 | Fife |
| 1,666,429 | A | 4/1928 | Stolp, Jr. |
| D75,433 | S | 6/1928 | Kelly |
| D75,612 | S | 6/1928 | Cotner |
| 1,672,713 | A | 6/1928 | Durbin |
| D75,761 | S | 7/1928 | Abraham |
| D75,762 | S | 7/1928 | Abraham |
| D76,843 | S | 11/1928 | Topping |
| 1,690,792 | A | 11/1928 | Neptune |
| D77,213 | S | 12/1928 | Abraham |
| D77,218 | S | 12/1928 | Caron |
| D77,277 | S | 12/1928 | Welch |
| D77,786 | S | 2/1929 | Melby |
| 1,701,640 | A | 2/1929 | Sherriff |
| 1,705,497 | A | 3/1929 | Overbury |
| 1,722,702 | A | 7/1929 | Kirschbraun et al. |
| 1,729,212 | A | 9/1929 | Fischer |
| 1,741,403 | A | 12/1929 | Caton |
| 1,741,539 | A | 12/1929 | Richardson |
| 1,741,566 | A | 12/1929 | Harris |
| 1,742,724 | A | 1/1930 | Perry |
| 1,748,981 | A | 3/1930 | Harris |
| 1,756,476 | A | 4/1930 | Audet |
| D81,200 | S | 5/1930 | Naterman |
| 1,765,796 | A | 6/1930 | Kirschbraun |
| 1,767,374 | A | 6/1930 | Kirschbraun |
| 1,768,280 | A | 6/1930 | Arcidiacono |
| D81,712 | S | 7/1930 | Moone |
| D81,768 | S | 8/1930 | Topping |
| 1,772,487 | A | 8/1930 | Horne |
| 1,772,924 | A | 8/1930 | Weller |
| 1,776,949 | A | 9/1930 | Lumbard |
| 1,791,571 | A | 2/1931 | Overbury |
| D83,624 | S | 3/1931 | Ledeboer |
| D83,704 | S | 3/1931 | Stark |
| D83,718 | S | 3/1931 | Brown |
| 1,794,719 | A | 3/1931 | MacLean |
| 1,800,403 | A | 4/1931 | Pfaff et al. |
| 1,802,868 | A | 4/1931 | Black |
| 1,805,292 | A | 5/1931 | Mosher |
| D84,668 | S | 7/1931 | Ralph |
| 1,825,576 | A | 9/1931 | Butterick |
| D85,638 | S | 12/1931 | Finley |
| D85,639 | S | 12/1931 | Finley |
| D86,085 | S | 1/1932 | Guy |
| 1,842,761 | A | 1/1932 | McCarthy |
| D86,194 | S | 2/1932 | Brown |
| 1,843,370 | A | 2/1932 | Overbury |
| 1,846,635 | A | 2/1932 | Finley |
| 1,850,680 | A | 3/1932 | Levin |
| 1,857,463 | A | 5/1932 | MacLean |
| D87,104 | S | 6/1932 | Eckert |
| 1,862,852 | A | 6/1932 | Harshberger |
| 1,873,944 | A | 8/1932 | Black |
| D88,995 | S | 1/1933 | Tobin |
| 1,898,989 | A | 2/1933 | Harshberger |
| D89,471 | S | 3/1933 | Streeter et al. |
| D89,639 | S | 4/1933 | Humphrey |

(56) References Cited

U.S. PATENT DOCUMENTS

| | | | |
|---|---|---|---|
| D89,783 | S | 5/1933 | Moone |
| D90,115 | S | 6/1933 | Harshberger |
| 1,913,768 | A | 6/1933 | Moone |
| 1,915,964 | A | 6/1933 | Wall |
| 1,920,474 | A | 8/1933 | Martin |
| 1,924,650 | A | 8/1933 | Payne |
| 1,927,436 | A | 9/1933 | Fischer |
| 1,928,285 | A | 9/1933 | Fischer |
| 1,928,835 | A | 10/1933 | Levis |
| D91,061 | S | 11/1933 | Fife |
| 1,935,656 | A | 11/1933 | Mortimer |
| 1,936,327 | A | 11/1933 | Fischer |
| 1,937,933 | A | 12/1933 | Yeager |
| D91,654 | S | 3/1934 | Harshberger |
| D91,744 | S | 3/1934 | Topping |
| D92,250 | S | 4/1934 | Harshberger |
| D92,132 | S | 5/1934 | Holdsworth |
| D92,379 | S | 5/1934 | Topping |
| D92,380 | S | 5/1934 | Topping |
| 1,958,560 | A | 5/1934 | Beckman |
| 1,959,960 | A | 5/1934 | Magrath |
| 1,961,005 | A | 5/1934 | Levin |
| D92,504 | S | 6/1934 | Topping |
| D92,632 | S | 6/1934 | Topping |
| D93,191 | S | 8/1934 | Topping |
| 1,974,047 | A | 9/1934 | Harshberger |
| D93,642 | S | 10/1934 | Topping |
| 1,993,134 | A | 3/1935 | Ford |
| 1,994,643 | A | 3/1935 | Harshberger |
| D95,242 | S | 4/1935 | Goslin |
| D95,731 | S | 5/1935 | Cahill et al. |
| 2,006,270 | A | 6/1935 | Harshberger |
| D96,547 | S | 8/1935 | Harshberger |
| 2,013,002 | A | 9/1935 | Logan |
| D95,824 | S | 11/1935 | Harshberger |
| 2,035,921 | A | 3/1936 | Quinn |
| D99,248 | S | 4/1936 | Piazza |
| D99,249 | S | 4/1936 | Piazza |
| 2,036,329 | A | 4/1936 | Giles |
| 2,037,507 | A | 4/1936 | Fischer |
| 2,045,423 | A | 6/1936 | Topping |
| 2,050,218 | A | 8/1936 | Abraham |
| 2,051,818 | A | 8/1936 | Buczkowski |
| 2,013,391 | A | 9/1936 | Searls |
| D101,732 | S | 10/1936 | Clow |
| 2,058,578 | A | 10/1936 | Eckert |
| D101,921 | S | 11/1936 | MacLean |
| 2,068,118 | A | 1/1937 | Topping |
| 2,068,767 | A | 1/1937 | Robert |
| 2,070,571 | A | 2/1937 | Beasley |
| 2,074,684 | A | 3/1937 | Eckert |
| 2,075,058 | A | 3/1937 | Robinson |
| D104,095 | S | 4/1937 | Fife |
| 2,078,998 | A | 5/1937 | Black |
| D104,948 | S | 6/1937 | Mickelson |
| D104,971 | S | 6/1937 | Logan |
| D105,124 | S | 6/1937 | Molyneux |
| 2,084,981 | A | 6/1937 | Anderson |
| 2,086,137 | A | 7/1937 | Ritter |
| 2,094,059 | A | 9/1937 | Buczkowskl |
| 2,096,968 | A | 10/1937 | Johnston |
| D107,209 | S | 11/1937 | Batell |
| 2,097,546 | A | 11/1937 | Brown |
| 2,099,131 | A | 11/1937 | Miller |
| 2,100,830 | A | 11/1937 | Altheide |
| 2,103,076 | A | 12/1937 | Harshberger et al. |
| 2,104,067 | A | 1/1938 | Bailey |
| 2,109,447 | A | 2/1938 | Sadtler |
| D109,077 | S | 3/1938 | Foley |
| 2,110,258 | A | 3/1938 | Blank |
| 2,111,565 | A | 3/1938 | Limerick |
| 2,111,798 | A | 3/1938 | Miller et al. |
| 2,112,194 | A | 3/1938 | Harshberger |
| 2,112,861 | A | 4/1938 | O'Hagen et al. |
| 2,113,644 | A | 4/1938 | Bollaert |
| 2,114,450 | A | 4/1938 | MacLean |
| 2,127,199 | A | 8/1938 | Austhoff |
| 2,128,836 | A | 8/1938 | McVoy |
| 2,129,288 | A | 9/1938 | Shattuck |
| 2,131,043 | A | 9/1938 | Harshberger et al. |
| 2,132,999 | A | 10/1938 | Topping |
| D112,998 | S | 1/1939 | Hunker |
| 2,142,177 | A | 1/1939 | Clapp |
| 2,142,181 | A | 1/1939 | Clapp |
| 2,148,167 | A | 2/1939 | Lyman |
| 2,150,883 | A | 3/1939 | O'Reilly |
| 2,161,440 | A | 6/1939 | Venrick |
| 2,168,217 | A | 8/1939 | Kirschbraun |
| 2,168,966 | A | 8/1939 | Karan |
| 2,170,534 | A | 8/1939 | MacNutt |
| 2,171,010 | A | 8/1939 | Schuetz et al. |
| 2,171,746 | A | 9/1939 | Guiterman |
| 2,174,098 | A | 9/1939 | Stein |
| 2,182,444 | A | 12/1939 | McKinnie |
| 2,182,526 | A | 12/1939 | Rumer |
| 2,187,139 | A | 1/1940 | Rowe |
| 2,187,203 | A | 1/1940 | Johnston |
| 2,190,654 | A | 2/1940 | Eichhorn |
| D119,439 | S | 3/1940 | Ritter |
| 2,196,420 | A | 4/1940 | Matthews |
| 2,196,847 | A | 4/1940 | Austin |
| 2,197,972 | A | 4/1940 | Ernst |
| 2,198,466 | A | 4/1940 | Stolze |
| 2,199,760 | A | 5/1940 | Schuetz |
| 2,201,175 | A | 5/1940 | Harshberger |
| 2,201,442 | A | 5/1940 | Mable, Jr. |
| 2,202,830 | A | 6/1940 | Bussey |
| 2,205,679 | A | 6/1940 | Ames, Jr. |
| 2,206,915 | A | 7/1940 | Ochs |
| 2,243,256 | A | 5/1941 | Miller |
| D127,883 | S | 6/1941 | Johnston |
| 2,250,764 | A | 7/1941 | Hoess |
| 2,253,662 | A | 8/1941 | Ritter |
| 2,260,446 | A | 10/1941 | Fooks, Jr. et al. |
| D131,018 | S | 1/1942 | Coburn |
| 2,276,170 | A | 3/1942 | Elmendorf |
| 2,284,705 | A | 6/1942 | Wickersham |
| 2,285,480 | A | 6/1942 | Wilde |
| 2,290,420 | A | 7/1942 | Fasold |
| 2,302,183 | A | 11/1942 | Burns |
| 2,307,734 | A | 1/1943 | DeVault |
| D135,035 | S | 2/1943 | Humphrey |
| D135,045 | S | 2/1943 | Bigler et al. |
| 2,323,230 | A | 6/1943 | McAvoy |
| 2,335,493 | A | 11/1943 | Drinkall |
| 2,336,191 | A | 12/1943 | Rose |
| 2,340,038 | A | 1/1944 | Buczkowski et al. |
| 2,347,250 | A | 4/1944 | Burnett |
| 2,348,223 | A | 5/1944 | Papesh |
| 2,370,803 | A | 3/1945 | Kronenbitter |
| 2,371,180 | A | 3/1945 | Moeller |
| D142,479 | S | 10/1945 | Helnning |
| D143,400 | S | 1/1946 | Coburn |
| D143,401 | S | 1/1946 | Coburn |
| D143,402 | S | 1/1946 | Coburn |
| D143,403 | S | 1/1946 | Coburn |
| D143,404 | S | 1/1946 | Coburn |
| D144,378 | S | 4/1946 | Harris |
| 2,421,766 | A | 6/1947 | Turman |
| 2,437,874 | A | 3/1948 | Black |
| 2,438,099 | A | 3/1948 | Whitehouse |
| D153,983 | S | 5/1949 | Rysdon |
| D160,866 | S | 11/1950 | Kellogg |
| D161,210 | S | 12/1950 | Ruggles |
| D161,945 | S | 2/1951 | Lorenz |
| D164,271 | S | 8/1951 | Abraham |
| D164,317 | S | 8/1951 | Papesh |
| D166,761 | S | 5/1952 | Langville |
| D167,474 | S | 8/1952 | Nettles |
| D168,668 | S | 1/1953 | Berini |
| 2,661,303 | A | 12/1953 | Fasold et al. |
| D173,327 | S | 10/1954 | Robert |
| D173,332 | S | 10/1954 | Volk |
| D177,808 | S | 5/1956 | Heft et al. |

(56) References Cited

U.S. PATENT DOCUMENTS

| | | | | |
|---|---|---|---|---|
| D178,460 | S | 8/1956 | Butler | |
| RE24,246 | E | 12/1956 | Fink | |
| 2,818,824 | A | 1/1958 | Read et al. | |
| D182,401 | S | 4/1958 | Borger et al. | |
| D186,086 | S | 9/1959 | Hadders | |
| 3,001,331 | A | 9/1961 | Brunton | |
| D195,334 | S | 6/1963 | Brockman | |
| 3,091,898 | A | 6/1963 | Fasold et al. | |
| 3,104,184 | A | 9/1963 | Wengenroth | |
| 3,111,788 | A | 11/1963 | Ouellet | |
| 3,138,897 | A * | 6/1964 | McCorkle | 52/420 |
| D199,939 | S | 12/1964 | Sewell | |
| 3,166,872 | A | 1/1965 | Cacossa | |
| D200,299 | S | 2/1965 | Pannullo et al. | |
| 3,200,652 | A | 8/1965 | Steck | |
| 3,233,382 | A | 2/1966 | Graveley, Jr. | |
| 3,237,361 | A | 3/1966 | Norman, Jr. | |
| 3,247,631 | A | 4/1966 | Lovness | |
| 3,252,257 | A | 5/1966 | Price et al. | |
| 3,262,239 | A | 7/1966 | Mills | |
| 3,267,834 | A | 8/1966 | Hockett | |
| 3,269,076 | A | 8/1966 | Marini et al. | |
| D208,294 | S | 8/1967 | Dallaire | |
| D208,887 | S | 10/1967 | Gillis | |
| 3,347,001 | A | 10/1967 | Cosden | |
| D209,719 | S | 12/1967 | Ellis | |
| 3,363,380 | A | 1/1968 | Merrill | |
| 3,376,683 | A | 4/1968 | Epstein | |
| 3,377,762 | A | 4/1968 | Chalmers et al. | |
| 3,380,215 | A | 4/1968 | Schaefer et al. | |
| D211,214 | S | 5/1968 | Bull | |
| 3,407,556 | A | 10/1968 | Lelbrook | |
| 3,412,518 | A | 11/1968 | Waite | |
| D212,874 | S | 12/1968 | Tiverton et al. | |
| 3,422,589 | A | 1/1969 | Harrison | |
| 3,468,092 | A | 9/1969 | Chalmers | |
| 3,484,267 | A | 12/1969 | Sadler, III | |
| 3,507,079 | A | 4/1970 | George | |
| 3,593,479 | A | 7/1971 | Hinds et al. | |
| D222,119 | S | 9/1971 | Green | |
| 3,605,369 | A | 9/1971 | Merrill et al. | |
| 3,613,328 | A | 10/1971 | Morgan, Jr. et al. | |
| 3,624,975 | A | 12/1971 | Morgan et al. | |
| 3,626,439 | A | 12/1971 | Kneisel | |
| 3,640,035 | A | 2/1972 | Butterfield | |
| 3,640,044 | A | 2/1972 | Watts | |
| 3,667,184 | A | 6/1972 | Merrill et al. | |
| 3,763,609 | A | 10/1973 | Probst | |
| 3,783,570 | A | 1/1974 | Storch | |
| 3,797,179 | A | 3/1974 | Jackson | |
| D236,254 | S | 8/1975 | Luther | |
| 3,897,667 | A | 8/1975 | Turek | |
| 3,899,855 | A | 8/1975 | Gadsby | |
| 3,903,340 | A | 9/1975 | Shepherd | |
| 3,919,823 | A | 11/1975 | Bradley | |
| 3,921,358 | A | 11/1975 | Bettoli | |
| 3,927,501 | A | 12/1975 | Allen et al. | |
| 3,973,369 | A | 8/1976 | Smith | |
| 4,001,997 | A | 1/1977 | Saltzman | |
| 4,015,374 | A | 4/1977 | Epstein et al. | |
| 4,079,561 | A | 3/1978 | Vallee | |
| D247,786 | S | 4/1978 | Flood | |
| D250,848 | S | 1/1979 | Naslund | |
| 4,143,499 | A | 3/1979 | Naslund | |
| D251,808 | S | 5/1979 | Patenaude | |
| 4,186,538 | A | 2/1980 | Marcum, Jr. | |
| 4,188,762 | A | 2/1980 | Tellman | |
| 4,188,763 | A | 2/1980 | Thiis-Evensen | |
| 4,194,335 | A | 3/1980 | Diamond | |
| 4,195,461 | A | 4/1980 | Thiis-Evensen | |
| 4,198,257 | A | 4/1980 | Pfaff | |
| D256,953 | S | 9/1980 | Morita | |
| D256,954 | S | 9/1980 | Morita | |
| 4,261,152 | A | 4/1981 | Tellman | |
| 4,262,466 | A | 4/1981 | Roe | |
| 4,266,388 | A | 5/1981 | Flood | |
| 4,274,243 | A | 6/1981 | Corbin et al. | |
| 4,295,445 | A | 10/1981 | Kopenhaver | |
| 4,301,633 | A | 11/1981 | Neumann | |
| 4,317,853 | A | 3/1982 | Thiis-Evensen | |
| 4,322,928 | A | 4/1982 | Freiborg | |
| 4,333,279 | A | 6/1982 | Corbin et al. | |
| D265,510 | S | 7/1982 | Bedwell, Jr. | |
| 4,352,837 | A | 10/1982 | Kopenhaver | |
| 4,399,186 | A | 8/1983 | Lauderback | |
| 4,404,783 | A | 9/1983 | Freiborg | |
| 4,405,680 | A | 9/1983 | Hansen | |
| D272,767 | S | 2/1984 | Nemeth | |
| D274,947 | S | 7/1984 | Culpepper, Jr. et al. | |
| 4,468,903 | A | 9/1984 | Eaton et al. | |
| 4,468,909 | A | 9/1984 | Eaton | |
| D277,411 | S | 1/1985 | Spinelli et al. | |
| 4,499,701 | A | 2/1985 | Bockwinkel et al. | |
| 4,499,702 | A | 2/1985 | Turner | |
| 4,527,374 | A | 7/1985 | Corbin | |
| 4,559,267 | A | 12/1985 | Freshwater et al. | |
| D282,287 | S | 1/1986 | McKeagan et al. | |
| 4,571,356 | A | 2/1986 | White, Sr. et al. | |
| 4,611,451 | A | 9/1986 | Symbold | |
| 4,637,191 | A | 1/1987 | Smith | |
| D288,771 | S | 3/1987 | Kero | |
| 4,672,790 | A | 6/1987 | Freiborg | |
| 4,717,614 | A | 1/1988 | Bondoc et al. | |
| 4,729,814 | A | 3/1988 | Jennus et al. | |
| 4,768,318 | A | 9/1988 | Freiborg | |
| D300,257 | S | 3/1989 | Stahl | |
| 4,817,358 | A | 4/1989 | Lincoln et al. | |
| 4,835,929 | A | 6/1989 | Bondoc et al. | |
| 4,848,057 | A | 7/1989 | MacDonald et al. | |
| 4,869,942 | A | 9/1989 | Jennus et al. | |
| D309,027 | S | 7/1990 | Noone et al. | |
| D313,278 | S | 12/1990 | Noone | |
| D313,658 | S | 1/1991 | Noone | |
| D314,439 | S | 2/1991 | Jenkins et al. | |
| D314,628 | S | 2/1991 | Jenkins et al. | |
| D317,506 | S | 6/1991 | Jenkins et al. | |
| D320,091 | S | 9/1991 | Paquette | |
| 5,052,162 | A | 10/1991 | Bush et al. | |
| D326,330 | S | 5/1992 | Klein | |
| D331,812 | S | 12/1992 | Bunger | |
| 5,181,361 | A | 1/1993 | Hannah et al. | |
| 5,195,290 | A | 3/1993 | Hulett | |
| 5,209,802 | A | 5/1993 | Hannah et al. | |
| D336,347 | S | 6/1993 | Hannah et al. | |
| 5,232,530 | A | 8/1993 | Malmquist et al. | |
| D339,875 | S | 9/1993 | Schutz et al. | |
| D340,294 | S | 10/1993 | Hannah et al. | |
| D341,667 | S | 11/1993 | Schultz et al. | |
| D344,144 | S | 2/1994 | Weaver et al. | |
| D347,900 | S | 6/1994 | Stapleton | |
| 5,369,929 | A | 12/1994 | Weaver et al. | |
| 5,611,186 | A | 3/1997 | Weaver | |
| 5,664,385 | A | 9/1997 | Koschitzky | |
| 5,666,776 | A | 9/1997 | Weaver et al. | |
| 5,822,943 | A | 10/1998 | Frankoski et al. | |
| 5,853,858 | A | 12/1998 | Bondoc | |
| 6,014,847 | A | 1/2000 | Phillips | |
| 6,190,754 | B1 * | 2/2001 | Bondoc et al. | 428/143 |
| 6,212,843 | B1 | 4/2001 | Kalkanoglu et al. | |
| 6,289,648 | B1 | 9/2001 | Freshwater et al. | |
| 6,467,235 | B2 | 10/2002 | Kalkanoglu et al. | |
| 6,679,020 | B2 | 1/2004 | Becker et al. | |
| 6,679,308 | B2 | 1/2004 | Becker et al. | |
| 6,708,456 | B2 | 3/2004 | Kiik et al. | |
| 6,990,779 | B2 | 1/2006 | Kiik et al. | |

OTHER PUBLICATIONS

Contractors Guide, Aug. 1988—Georgia Pacific Advertisement.

Brochure, Residential Roofing Products "The Stars of our line are Helping Keep America Beautiful".

Advertisement, The Ruberoid Co., American Builder, Apr. 1952.

Advertisement, The Ruberoid Co., Sweet's Catalogue File, 1952.

(56) References Cited

OTHER PUBLICATIONS

The Ruberoid Co. Annual Report 1941 to Stockholders and Employees.
Advertisement, GAF Timberline "Natural Shadow" Timberline Series.
Advertisement, GAF "The Roof the Neighbors Look Up To".
Brochure, GAF Timberline Series Ultra "Natural Shadow", 1994.
Brochure, GAF Timberline Ultra "Natural Shadow", 1993.
Brochure, GAF Timberline Ultra "Natural Shadow" Color Selector, 1994.
Brochure, GAF "Natural Shadow", 1994.
Brochure, GAF, "The Roof the Neighbors Look Up To.", 1994.
Brochure, GAF, The GAF Timberline Series, "Natural Shadow, 1994".
Brochure, GAF Residential Roofing, 1993.
Celotex Brochure (2 pages), Jun. 1982.
Declaration of Matti Kiik dated Feb. 1, 1994.
Roofs Catalogue by the Flintkote Company, Jul. 1929, p. 20, slate-tone shingles illustration at top center.
1982 Sweets Catalogue File, Products for Light Residential Construction 7.7 Jo, p. 2 illustration.
1982 Sweets Catalogue File, Products for Light Residential Construction 7.7 Jo, p. 4, The Woodlands Roof.
Carey.RTM. Fire-Chex Roofing Catalogue Form No. 6295-57-956-NL (from 1957 Sweets Catalogue) (20 sheets).
Carey.RTM. Fire-Chex Rustic Shake Catalogue From 1967 Sweets Catalogue (47M-936-HC) (8 pages).
The Roofing Collection .RTM., CertainTeed, Horizon Shangle. RTM., 1991, CertainTeed Corporation.
Asphalt Roofing Manufacturers Association, "Residential Asphalt Roofing Manual," Cover page through 7, .Copyrgt. 1984, 1988.
Elk Corporation, "Prestique .RTM., High Definition Shingles," .TM. 1991 Elk Corporation.
Brochure GS Roofing Products Company High Sierra.TM. Premier Heavyweight Laminated Shingles Advertisement (1 sheet).
Video entitled "3M/IMP Roofing Granules IMP".
Brochure Pabco Roofing Products "PABCO.RTM. HM-30.TM. Extra Protection, Durability and Beauty" (4 sheets).
Brochure Pabco Roofing Products "PABCO.RTM. HO-25.TM. Protection and Beauty Beyond the Ordinary" (2 sheets).
Brochure Pabco Roofing Products "PABCO.RTM. SG-25.TM. Extra Protection and Longer Life" (2 sheets).
Brochure Pabco Roofing Products "PABCO.RTM. GG-20.TM. The Most Economical U/L Class 'A' Roof" (4 sheets).
Brochure Owens/Corning Fiberglas.TM. "Oakridge.TM. Dimensional Shingles" Apr. 1988 (10 sheets).
Brochure Atlas Roofing Corporation "Residential Roofing Products" pp. 1-8.
Brochure Dura Ridge (2 sheets).
Brochure TrendRidge.RTM. (2 sheets).
Brochure Tamko Roofing Products "Residential Roofing Products" 1990 (10 sheets).
Pages from "Tonal Values, How to See Them, How to Paint Them" by Angela Gair (cover page and pp. 6, 18, 29, 30 and 43).
Pages from North Light Art School, "Observation & Drawing" (cover page, front page and pp. 10, 11 and 33).
Brochure, Carey Fire Chex Roofing, Sep. 1966.
Brochure, Carey, The Philip Carey Manufacturing Company.
Picture, Fire-Chex 400.
Picture, Rustic Shakes.
Color copy of two photographs of pages from the 1966 Philip Carey Catalogue and the 1967 Sweets Catalogue (1 sheet).
Color copy of five photographs of pages from Carey Fire-Chex Roofing Catalogue, 1967.
Sweets Catalogue (2 sheets).
Color photograph of 3M three-tab shingle.
"GAF-ELK Timberline® Natural Shadow™ Roofing Shingles" www.susselbuilders.com/exteriors/roofing/timberline-architectural/natural-shadow.

* cited by examiner

ENHANCED SINGLE LAYER ROOFING MATERIAL

FIELD OF THE INVENTION

This invention relates to an improved roofing product, and in particular, to a single layer roofing material having color gradients or gradations to create the illusion of thickness or depth on a relatively flat surface.

BACKGROUND OF THE INVENTION

Asphalt roofing products are often divided into three broad groups: shingles, roll roofing and underlayment. Shingles and roll roofing typically function as outer roof coverings designed to withstand exposure to weather and the elements. Shingles and roll roofing generally contain the same basic components which provide protection and long term wear associated with asphalt roofing products. These components include a base material made from an organic felt or fiberglass mat which serves as a matrix to support the other components and gives the product the required strength to withstand manufacturing, handling, installation and service in the intended environment. An asphalt coating formulated for the particular service application is often applied to the base material to provide the desired long-term ability to resist weathering and to provide stability under the anticipated temperature extremes. An outer layer of mineral granules is also commonly applied to the asphalt coating to form a surface exposed to the weather which shields the asphalt coating from the sun's rays, adds color to the final product and provides fire resistance.

Asphalt shingles are one of the most commonly used roofing materials. Such shingles are typically manufactured as single layer strip shingles, laminated shingles having two or more layers, interlocking shingles and large individual shingles in a variety of weights and colors. Such asphalt shingles are also often referred to as composite shingles. Even though composite and/or asphalt shingles offer significant cost, service life and flammability advantages over wood shingles, wood shingles are still often preferred due to the pleasing aesthetic appearance of a wood shingled roof. An important aesthetic advantage of such wood shingles is their greater thickness as compared to composite shingles. The thickness of wood shingles results in a more pleasing, layered look for the finished roof.

Various composite shingles have been developed to provide an appearance of thickness comparable to wood shingles. Examples of such composite or asphalt shingles are shown in U.S. Pat. No. 6,708,456 entitled Roofing Composite; U.S. Pat. No. 6,679,020 and U.S. Patent Application Publication No. 2003/0097811 entitled Multi-layered Shingle and Method of Making Same; U.S. Pat. No. 6,467,235 entitled Method and Apparatus for Making a Thick-Appearing Shingle; U.S. Pat. No. 6,289,648 entitled Laminated Roofing Shingle; U.S. Pat. No. 6,212,843 entitled Thick-Appearing Shingle and Method and Apparatus for Making Same; U.S. Pat. No. 6,014,847 entitled Laminated Roofing Shingle Having Staggered Shadow Lines and Method of Making the Same; U.S. Pat. No. 5,853,858 entitled Multihued Shingle Sheet; U.S. Pat. No. 5,822,943 entitled Hurricane Resistant Shingle; U.S. Pat. No. 5,666,776 entitled Laminated Roofing Shingle; U.S. Pat. No. 5,664,385 entitled Shingle With Slots and Method of Making Same; U.S. Pat. No. 5,611,186 entitled Laminated Roofing Shingle; U.S. Pat. No. 5,369,929 entitled Laminated Roofing Shingle; U.S. Pat. No. 5,232,530 entitled Method of Making a Thick Shingle; U.S. Pat. No. 4,717,614 entitled Asphalt Shingle; U.S. Pat. No. 3,921,358 entitled Composite Shingle; and design and U.S. Pat. No. D309,027 entitled Tab Portion of a Shingle.

U.S. Pat. No. 6,708,456 describes a roofing composite including a roofing material and an interply material attached to the roofing material. The interplay material is attached to an edge of the roofing material and is scored to permit a major portion of the interply material to be folded away from the roofing material for application to a roof. The drawings of the '456 patent include embodiments that show coloration to enhance the appearance of thickness in the laminated roofing shingles attached to the interply material.

U.S. Pat. No. 6,679,020 and U.S. Patent Application Publication No. 2003/0097811 describe laminated shingles having dragon teeth, wherein the laminated portion of the shingle enhances the thickness of the dragon teeth region.

U.S. Pat. Nos. 6,467,235 and 6,212,843 describe shingles with tabs that have a thickened appearance. The tabs include visually distinct shading areas that are transverse and vertical to a center region of the tab, which gives the tab a thicker appearance.

U.S. Pat. No. 6,014,847 describes a laminated shingle having an underlay and an overlay. The overlay has a plurality of spaced apart tabs and portions of the underlay are exposed between the spaces of the tabs. The tabs of the overlay have granules that provide an alternating pattern of color from top to bottom of dark, light and dark. The portion of the underlay that is exposed between the spaces of the tabs has a granule pattern such that from top to bottom the pattern is dark then light. The laminated shingles have an enhanced three-dimensional appearance.

U.S. Pat. No. 5,853,858 describes a shingle having spaced apart tabs. The shingle includes a top section that has an upper un-exposable portion and a lower exposable portion. The lower exposable portion has a horizontal band of distinguishable color patterns. The shingle also has a tab portion with a plurality of tabs wherein each of the tabs is of a distinguishable color pattern. When the shingle is applied to a structure, the exposable portion of the top section is seen between tabs such that different colors are seen from tab to the exposed lower portion of the top section, to the tab, etc., thus providing a multi-hued appearance.

U.S. Pat. No. 5,822,943 describes a hurricane resistant laminated shingle.

U.S. Pat. Nos. 5,369,929, 5,666,776 and 6,289,648 describe laminated shingles having a headlap section and a buttlap section with a least one portion of the buttlap section being relatively uniform in color and another portion of the buttlap section having a color gradient or gradation from light to dark, wherein an illusion of depth is created on the portion of the buttlap section having the color gradient. The relatively uniform color section of the buttlap may be formed on tabs or dragon teeth on an overlay of the laminated section whereas the color gradient is formed on an underlay of the laminated shingle.

U.S. Pat. No. 5,664,385 describes a shingle having areas of differing colors that are disposed horizontally on an exposable lower portion of the shingle. Slots are created between the differing colors to create tabs with a visual demarcation of color between the adjacent areas. The upper portion of the shingle, which is largely unexposable, is darker in color than the lower portion. When the shingle is applied to the roof the lower portion overlaps the upper portion and the darker color of the upper portion is visible through the slots, thus creating a greater visual demarcation between adjacent tabs.

U.S. Pat. No. 5,611,186 describes a laminated shingle having a headlap section and a buttlap section with a least one portion of the buttlap section being relatively uniform in color and another portion of the buttlap section having a value gradation from light to dark, wherein an illusion of depth is created on the portion of the buttlap section having the color gradient. A desired value gradation is achieved with a plurality of horizontal striations with transition stripes disposed between adjacent horizontal striations.

U.S. Pat. Nos. 5,232,530, 4,717,614 and 3,921,358 describe laminated shingles with a thickened appearance due to the backing adhered to the shingle.

U.S. Design Pat. No. D309,027 describes a single layer shingle with tabs having varying color bands.

Each of the above-referenced patents is incorporated herein by reference for all purposes within this application.

SUMMARY OF THE INVENTION

In accordance with the present invention, a single layer roofing material is provided which, when installed on a roof, creates the illusion of an enhanced thickness laminated shingle. In accordance with one aspect of the present invention, a color gradient or gradation is placed on a portion of the roofing material to create the illusion of thickness or depth on a relatively flat surface. The resulting roofing material, when installed, has the appearance of depth or thickness associated with, for example, wood shingles. The single layer or single layer roofing materials of the present invention have tabs or dragon teeth extending from a headlap portion of the roofing material.

In accordance with one aspect of the present invention, a roofing material is provided having tabs and a headlap wherein the tabs and a portion of the headlap, when the roofing material is installed on a roof, are exposed surfaces or weather surfaces. The tabs have alternating portions of relatively uniform color adjacent to exposed headlap portions having a colored gradient from light to dark. If desired, the relatively uniform color portions of the tabs may vary in contrast with respect to each other. In one embodiment of the present invention the tab portion of the roofing material has a plurality of dragon teeth or tabs with openings therebetween. Each dragon tooth preferably has a relatively uniform color. In other embodiments, each dragon tooth may have color variations. When the single layer roofing material of the invention is applied to a roof deck in the form of a shingle, the headlap of a first shingle is partially covered by the dragon teeth of the tab portion of a second shingle and partially exposed by the openings between the dragon teeth. The exposed portions of the headlap preferably have a color gradient from light to dark to create the illusion of depth. The color gradient may be formed by a plurality of horizontal striations on the headlap. The number and width of horizontal striations formed on the headlap may be varied to provide the desired transition in color and contrast from light to dark to create the illusion of depth or thickness. In accordance with another embodiment of the invention, transition stripes may be disposed between horizontal striations to provide a value gradation with enhanced differences in contrast on portions of the headlap. The use of transition stripes can prevent the enhanced difference in contrast from presenting a confused or disjointed appearance.

DETAILED DESCRIPTION OF THE FIGURES

For a more complete understanding of the present invention, and the advantages thereof, reference is now made to the following descriptions taken in conjunction with the accompanying figures, in which.

DETAILED DESCRIPTION

The preferred embodiments of the present invention and its advantages are best understood by referring to FIGS. 1 through 10, like numerals being used for like and corresponding parts of the various drawings.

Figure 1:
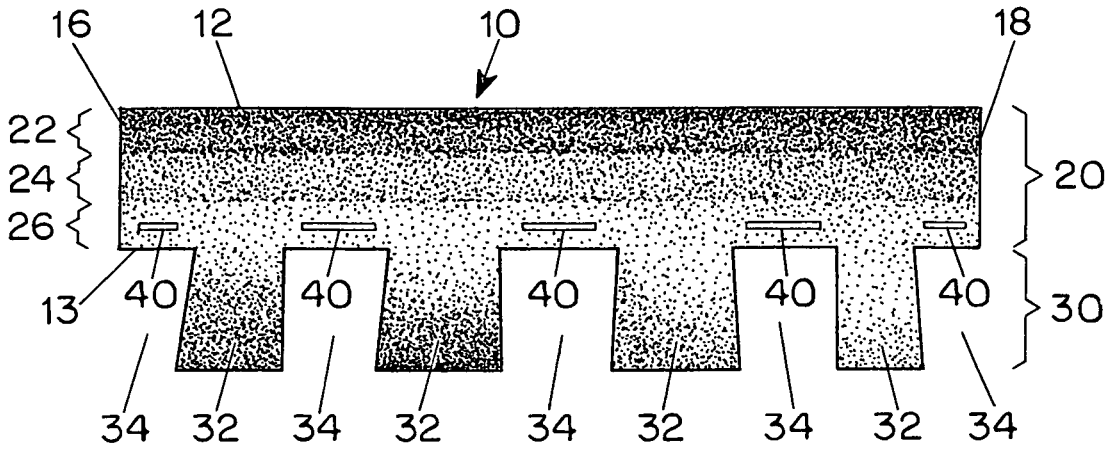
FIG. 1 shows an exemplary embodiment of a single layer shingle of the present invention wherein the headlap has three horizontal striations.
Figure 5:
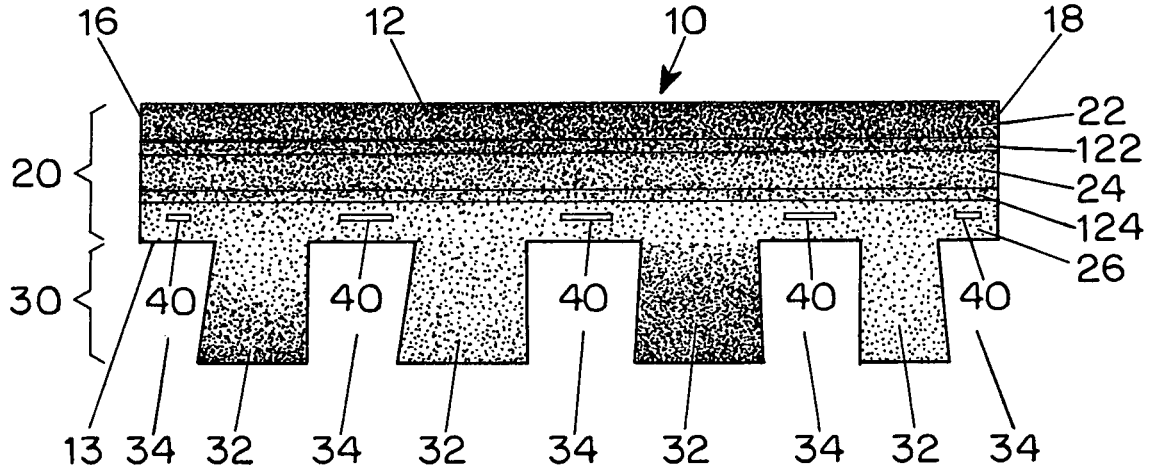
FIG. 5 shows an exemplary embodiment of a single layer shingle of the present invention wherein the headlap has three horizontal striations and two transition stripes.

Single layer shingle 10 incorporating one embodiment of the present invention is shown in FIGS. 1 and 5. Single layer shingle 10 preferably comprises a headlap 20 and a tab portion 30. Tab portion 30 has a plurality of tabs 32 extending from the headlap. Tabs 32 may also be referred to as "dragon teeth". A plurality of openings 34 are formed between adjacent tabs 32. The openings 34 may also be referred to as "valleys".

Figure 2:
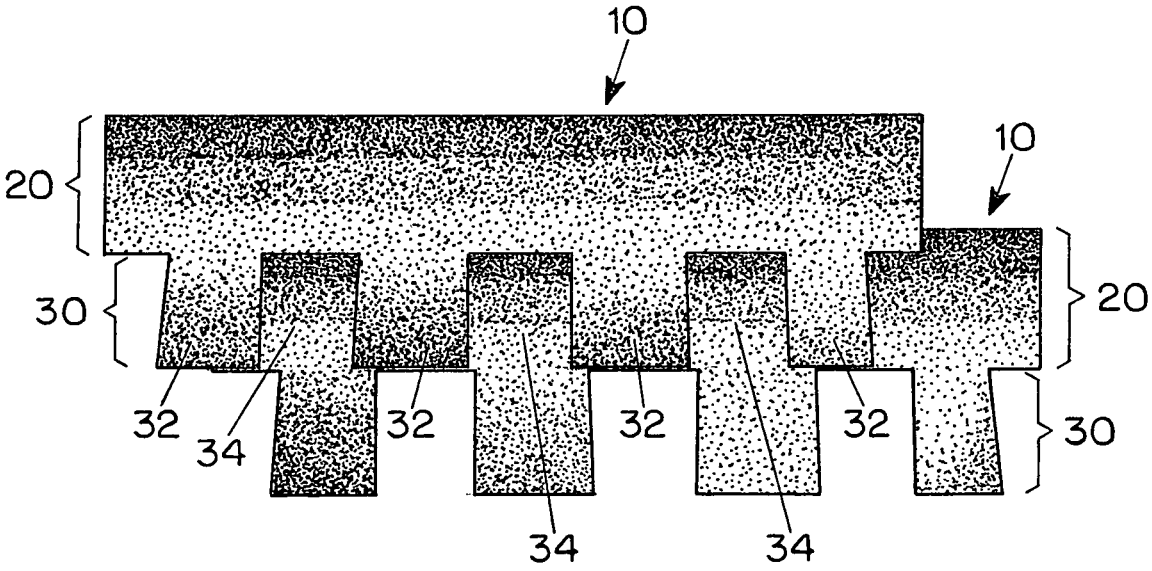
FIG. 2 shows an exemplary embodiment of two single layer shingles of the present invention as they would be applied to a structure, such as a roof deck.
Figure 3:
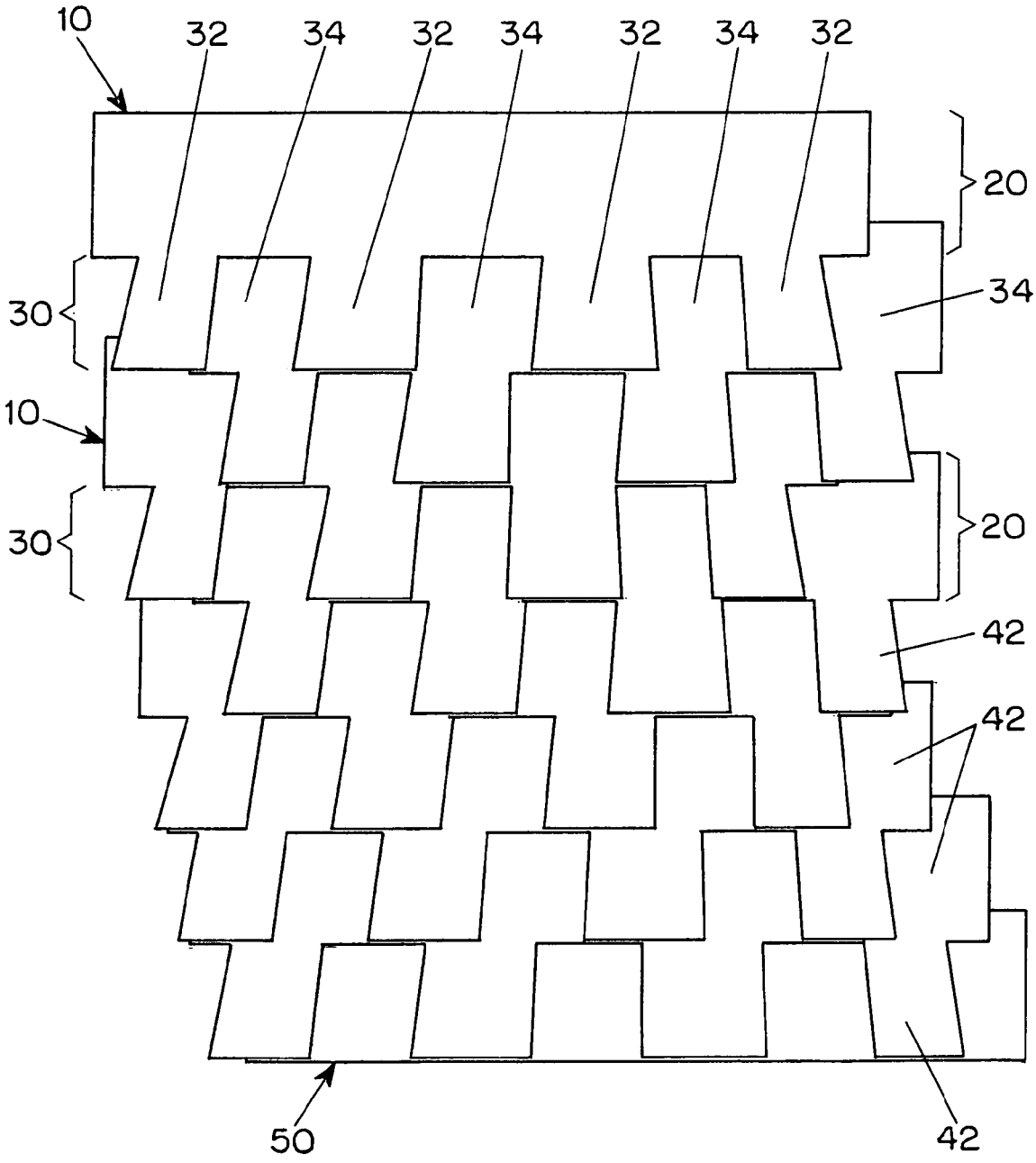
FIG. 3 shows and exemplary embodiment of eight single layer shingles of the present invention as they would be applied to a structure, such as a roof deck.

FIGS. 2 and 3 show single layer shingles of the present invention installed on top of one another as they would be applied to a roof deck. The headlap 20 is disposed beneath tabs 32 with portions of the headlap 20 exposed through the associated openings 34.

Referring again to FIG. 1, single layer shingle 10 has a generally rectangular configuration defined in part by longitudinal edges 12 and 14 with lateral edges 16 and 18 disposed therebetween. Longitudinal edge 12 defines the upper edge of the single layer shingle 10. Longitudinal edge 14 defines the lower edge or leading edge of single layer shingle 10. A plurality of self-sealing adhesive strips 40 is preferably disposed, on the exterior surface of the headlap 20, for example, above each tab 32 of the tab portion 30. Alternatively, or in addition to self-sealing adhesive strips 40, the single layer shingle of the invention may further comprise self-sealing adhesive strips on the backside of the shingles on the tab portion.

Figure 6:
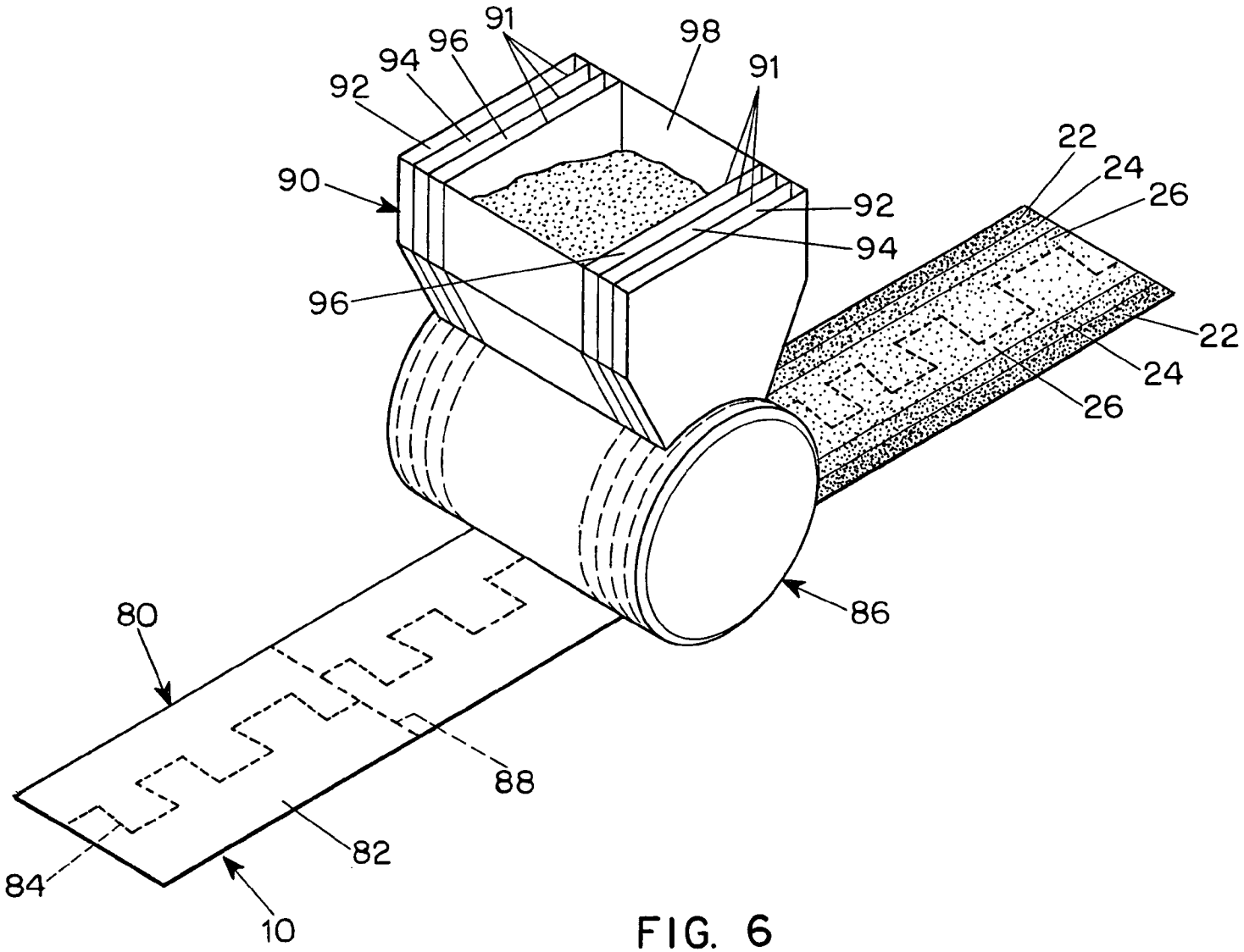
FIG. 6 shows an isometric, schematic drawing of an exemplary sheet of roofing material of the present invention from which components for the single layer shingle of FIG. 1 may be obtained wherein the headlap portion of the shingle has three horizontal striations.

Depending upon the desired application and appearance of each shingle 10, tabs 32 may have equal or different widths and may have a square, rectangular, trapezoidal, or any other desired geometric configuration. In the same respect, openings 34 may have equal or different widths and may have a square, rectangular, trapezoidal or any other desired geometric configuration. As will be explained later in more detail, single layer shingles 10 may be formed from a single sheet 80 of roofing material with tabs 32 and openings 34 formed as a "reverse image" of each other, as shown in FIG. 6 and described in greater detail below.

For one embodiment of the present invention, single layer shingle 10 may be formed from a fiberglass mat (not shown) with an asphalt coating on both sides of the mat. If desired, the present invention may also be used with shingles formed from organic felt or other types of base material, including but not limited to synthetic mats or synthetic glass/hybrid mats having an appropriate coating. Nonlimiting embodiments of coatings include, asphalt and modified bituminous coatings based on atactic polypropylene (APP), styrene-butadiene-styrene (SBS), styrene-ethylene-butadiene-styrene (SEBS), amorphous polyalpha olefin (APAO), thermoplastic polyolefin (TPO), synthetic rubber or other asphaltic modifiers.

Referring to FIG. 3, the exposed outer surface or weather surface 42 of single layer shingle 10 is defined in part by tabs 32 and the portions of the headlap 20 which are exposed through openings 34 between adjacent tabs 32 when the shingles are applied to a roof deck. Weather surface 42 of single layer shingle 10 may be coated with various types of mineral granules to protect the asphalt coating, to add color to single layer shingle 10 and to provide fire resistance. For some applications, ceramic-coated mineral granules may be used to form the outer layer comprising weather surface 42. Also, a wide range of mineral colors from white and black to various shades of red, green, brown and any combination thereof may be used to provide a roof having the desired color for shingle 10. The underside of shingle 10 may be coated with various inert minerals with sufficient consistency to seal the asphalt coating.

An important feature of the present invention includes providing a plurality of horizontal striations on the surface of headlap 20 which is exposed through openings 34. For the embodiment of the present invention shown in FIGS. 1 through 3 and 5, headlap 20 has at least three horizontal striations 22, 24, and 26. These horizontal striations provide a color gradient or gradation from light starting at leading edge 13 to dark at the upper edge 12. It should be noted however that any color-value gradation that gives the appearance of depth may be used. For example, the gradation may be dark starting at leading edge 13 to light at the upper edge 12. In order to achieve a color-value gradient or gradation, adjacent striations should have a different color value. In certain embodiments, different color values may be achieved by using different colors for adjacent striations.

The number of horizontal striations and the width of each striation on headlap 20 may be varied depending upon the desired aesthetic appearance of the resulting single layer shingle 10. In certain embodiments, the color gradient formed on headlap 20 may include as few as two striations or more than a dozen striations, with each striation having a width of one quarter of an inch to one half of an inch. However, it is appreciated by the skilled artisan that the number and width of each striation will differ depending on the particular desired appearance and depending on the size and shape of the roofing material. Also, each striation may have a different color and tone to establish the desired amount of contrast. Contrast for purposes of this patent application is defined as the degree of difference in the tone or shading between areas of lightest and darkest color.

Figure 10:
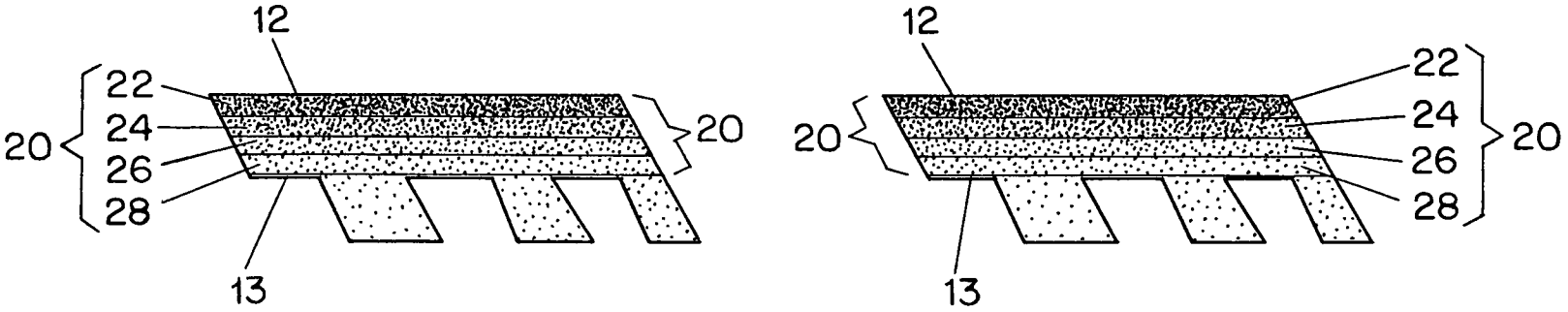
FIG. 10 shows an exemplary embodiment of a single layer shingle of the present invention wherein the headlap has four horizontal striations.

In another embodiment of the invention, as shown in FIG. 10, the headlap 20 has at least 4 horizontal striations 22, 24, 26 and 28. These striations provide a color gradient or gradation from light starting at leading edge 13 to dark at upper edge 12. The first striation 22 includes a first elongated quadrilateral area with a substantially uniform dark color throughout the first quadrilateral area. The second striation 24 includes a second elongated quadrilateral area below the first striation 22. The second striation 24 has a substantially uniform color throughout the second quadrilateral area, which is lighter than the color of the first striation 22. The third striation 26 includes a third elongated quadrilateral area below the second striation 24. The third striation 26 has a substantially uniform color throughout the third quadrilateral area, which is lighter than the color of the second striation 24. The fourth striation 28 includes a fourth elongated quadrilateral area below the third striation 26. The fourth striation 28 has a substantially uniform color throughout the fourth quadrilateral area, which is lighter than the color of the third striation 26.

For some applications, a gradual change in contrast associated with a large number of striations may provide the appearance of depth or thickness associated with wood or other natural products. Also, the amount or degree of contrast in the color-value gradient exposed in each opening 34 may be varied depending upon the desired aesthetic appearance. An important feature of the present invention is the ability to vary the color gradient and the amount of contrast to provide the desired illusion or appearance of thickness on the finished roof.

Referring now to FIG. 5, to achieve a more gradual change in the color-value gradient, transition stripes 122 and 124 may be included between horizontal striations 22, 24 and 26. These transition stripes are described in greater detail below.

Figure 4:
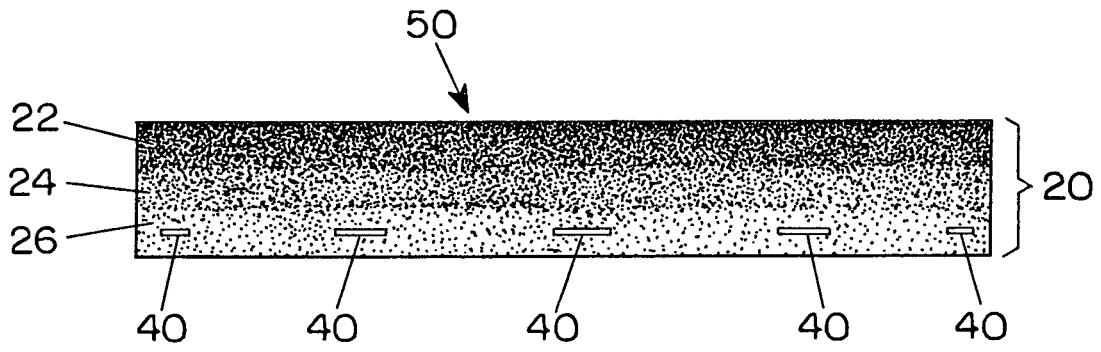
FIG. 4 shows an exemplary embodiment of a starter strip of the present invention.

As best shown in FIG. 3, a plurality of single layer shingles 10 may be installed on a roof deck or other structure to afford protection from the environment and to provide an aesthetically pleasing appearance. The normal installation procedures for single layer shingle 10 include placing each shingle 10 on a roof with an overlapping configuration. Typically, tab portion 30 of one shingle 10 will be disposed on the headlap portion 20 of a shingle 10 previously applied to the roof deck. FIG. 4 shows a starter sheet 50 that preferably comprises only the headlap portion 20 of single layer shingle 10. The starter sheet 50 may be applied as a first row starting at a hip, ridge or rake of a roof. A single layer shingle 10 of the invention may then be placed upon the starter strip 50. Self-sealing adhesive strips 40 are used to enhance securing the overlapping shingles 10 with each other. Also, a limited lateral offset is preferably provided between horizontally adjacent rows of shingle 10 to provide an overall aesthetically pleasing appearance for the resulting roof.

FIG. 6 shows one procedure for fabricating laminated shingle 10 from sheet 80 of roofing material. Various procedures and methods may be used to manufacture sheet 80 of roofing material from which the roofing material, such as shingles and roll roofing incorporating the present invention may be fabricated. Examples of such procedures are contained in U.S. Pat. No. 1,722,702 entitled Roofing Shingle; U.S. Pat. No. 3,624,975 entitled Strip Shingle of Improved Aesthetic Character; U.S. Pat. No. 4,399,186 entitled Foam Asphalt Weathering Sheet for Rural Roofing Siding or Shingles; and U.S. Pat. No. 4,405,680 entitled Roofing Shingle. Each of these preceding patents is incorporated by reference for all purposes within this application.

Sheet 80 is preferably formed from a fiberglass mat placed on a jumbo roll (not shown) having a width corresponding to sheet 80. Single layer shingles 10 are typically fabricated in a continuous process starting with the jumbo roll of fiberglass mat. As previously noted, single layer shingle 10 may also be fabricated using organic felt or other types of base material.

Sheet 80 shown in FIG. 6 preferably comprises a fiberglass mat with an asphalt coating which both coats the fibers and fills the void spaces between the fibers. A powdered limestone stabilizer (not shown) may be included as part of the asphalt coating process. A smooth surface of various inert minerals of sufficient consistency may be placed on the bottom surface of sheet 80 to seal the asphalt coating.

Top surface 82 is preferably coated with a layer of mineral granules such as ceramic-coated stone granules to provide the desired uniform color portions and the color gradient portions associated with weather surface 42. FIG. 6 shows a schematic representation of roller 86 and mineral granular hopper 90 which may be used to provide the desired granular surface coating to sheet 80. Hopper 90 includes a plurality of partitions 91 which divide storage bin 90 into compartments 92, 94, 96 and 98. The larger compartment or central compartment 98 of hopper 90 preferably contains a uniform mixture of the mineral granules which will produce the desired color on dragon teeth or tabs 32 which will be exposed to the environment. This transfer of mineral granules is sometimes referred to as a "color drop."

For the embodiment shown in FIGS. 1 through 3 and 5, headlap portion 20 has color striations of mineral granules. As previously noted, an important feature of the present invention includes providing tabs 32 having a relatively uniform color and a headlap portion 20 having a color gradient from light to dark to create the appearance of depth or thickness on weather surface 42 created when the shingles are applied to a structure, such as a roof deck. The color of the surface layer on headlap portion 20 may be varied as desired for each application.

As illustrated in FIG. 6, different colored mineral granules corresponding to the desired horizontal striations 22, 24 and 26 are preferably placed in the appropriate compartments 92, 94 and 96. As sheet 80 passes under roller 86, mineral granules from the appropriate compartment in hopper 90 will fall onto roller 86 and be transferred from roller 86 to top surface 82 of sheet 80. The volume or pounds per square foot of mineral granules placed on surface 82 is preferably the same throughout the full width of sheet 80. By dividing hopper bin 90 into compartments, the color of various portions of sheet 80 may be varied including providing horizontal striations 22, 24 and 26 for headlap 20. The rotation of roller 86 and the movement of sheet 80 are coordinated to place the desired color drop on each shingle 10.

As shown by dotted line 84 in FIG. 6, after the granule application, sheet 80 may be cut into two horizontal lengths or lanes. The shingle may cut along the vertical length of sheet 80 at dotted line 88.

The cut along dotted line 84 corresponds with the desired pattern for dragon teeth 32 and associated openings 34. For some applications, six horizontal lengths or lanes may be cut from a sheet of roofing material similar to sheet 80. The number of lanes is dependent upon the width of the respective sheet of roofing material and the desired width of the resulting shingles.

Figure 7:
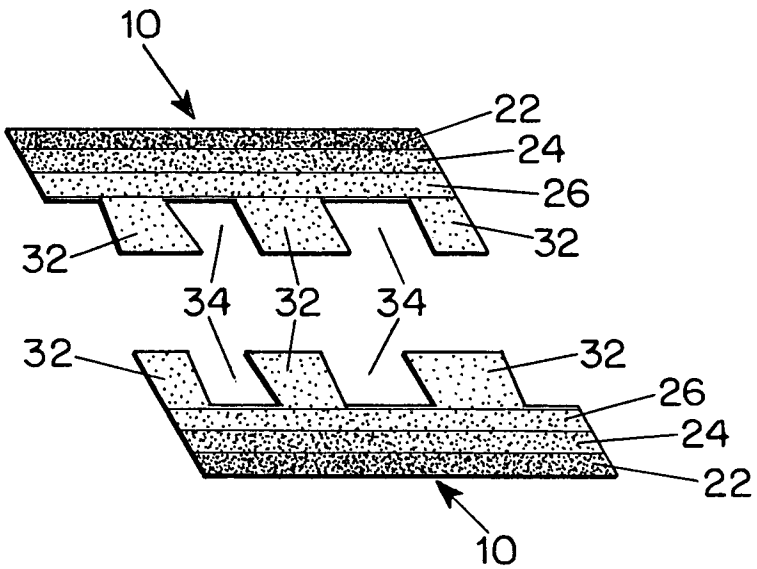
FIG. 7 is an exploded isometric view with portions broken away showing components taken from the sheet of roofing material shown in FIG. 6 which may be used to form the single layer shingle of FIG. 1 wherein the headlap portion of the shingle has three horizontal striations.
Figure 7:
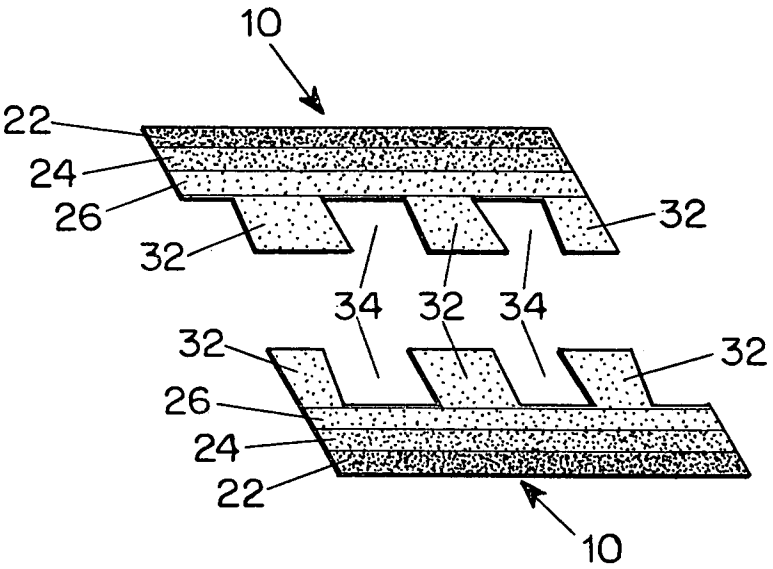

As shown in FIG. 7, each lateral cut of sheet 80 results in single layer shingle 10. The resulting shingles are then packaged with the desired color configuration for future installation on a roof.

Figures 8A, 8B:
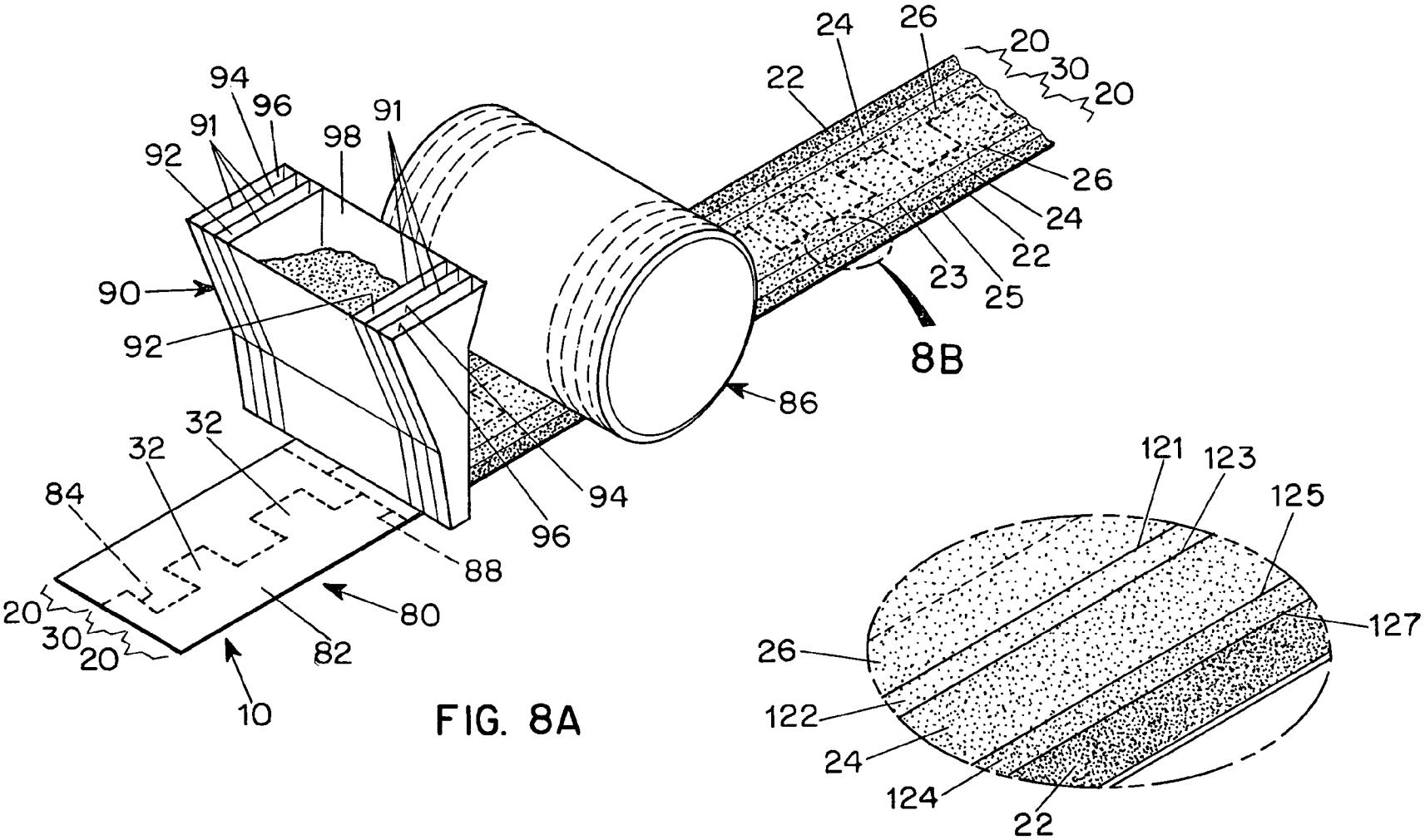
FIG. 8A shows an isometric, schematic drawing of an exemplary sheet of roofing material of the present invention from which components for the single layer shingle of FIG. 5 may be obtained wherein the headlap portion of the shingle has transition stripes.
FIG. 8B shows an exploded isometric view showing the transition stripes disposed between adjacent horizontal striations of the roofing material shown in FIG. 8A.
Figure 9A:
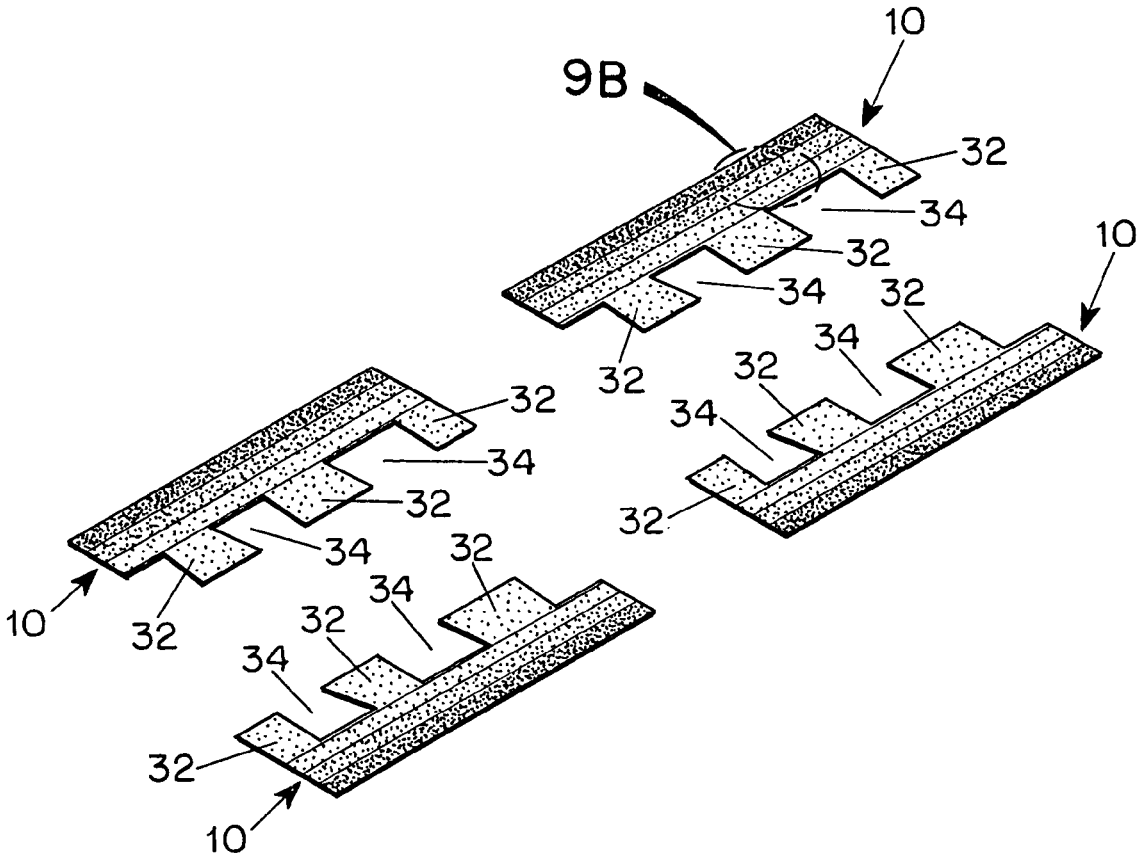
FIG. 9A shows an exploded isometric view with portions broken away showing components taken from the sheet of roofing material shown in FIG. 8A which may be used to form the single layer shingle of FIG. 5 wherein the headlap portion of the shingle has transition stripes disposed between the adjacent horizontal strips.
Figure 9B:
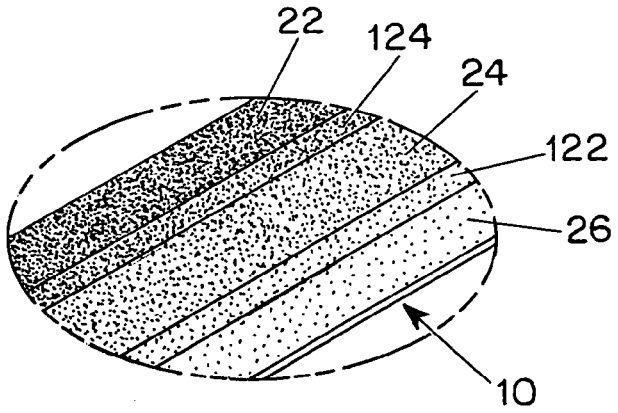
FIG. 9B shows an exploded isometric view showing the transition stripes disposed between adjacent horizontal striations of the roofing material shown in FIG. 8A.

As shown in FIGS. 5, 8 and 9, in another embodiment, single layer shingle 10 preferably includes transition stripes 122 and 124 disposed between horizontal striations 22, 24 and 26. FIGS. 8B and 9B more fully depict the relationship between horizontal striations 22, 24 and 26 and the associated transition stripes 122 and 124. For some applications, an enhanced appearance of depth may be created on laminated shingle 10 by forming horizontal striation 22 from relatively light value and horizontal striation 26 from relatively dark value with a large difference on contrast between the light value and the dark value.

It is important to note that conventional procedures for fabricating shingles having an exterior surface formed by mineral granules include the use of granule blenders and color mixers, along with other sophisticated equipment to ensure a constant uniform color at each location on the exposed portions of the shingles. Procedures may be used to ensure that each color drop on a sheet of roofing material is uniform. The color drop between shingles may be varied to provide different shades or tones in color.

The difference in calorimetric readings between the lightest and the darkest value or the contrast between horizontal striations 22 and 26 may vary substantially. A colorimeter or other suitable testing equipment may be used to measure the value of light or dark contrast associated with horizontal striations 22 and 26 to evaluate the desired difference in value or contrast between the respective striations. The colorimeter measures units of color (L) as a measure of light reflectance from 0 (black) to 100 (white). L is a standard measurement unit of color that has been defined by the International Commission on Illumination (abbreviated CIE based on its French name). In one embodiment, the difference in calorimeter readings between the lightest value and the darkest value or the contrast between horizontal striations 22 and 26 may vary from approximately two (2) L to approximately thirty (30) L depending on the selected generic color and its associated tone. In another embodiment, the contrast between horizontal striations 22 and 26 may vary from approximately four (4) L to approximately twelve (12) L depending on the selected generic color and its associated tone.

Transition stripe 122 may be formed from a relatively uniform mixture of approximately fifty percent (50%) ceramic coated mineral granules associated with horizontal striation 22 and approximately fifty percent (50%) ceramic coated mineral granules associated with horizontal striation 24. In the same respect, transition stripe 124 may be formed from a relatively uniform mixture of the respective ceramic-coated mineral granules used to form horizontal striations 24 and 26.

For other applications, the ratio of ceramic coated mineral granules from adjacent horizontal striations may be varied from twenty-five percent (25%) to seventy-five percent (75%). The present invention allows the specific ratio of mineral granules used to form each transition stripe to be varied depending upon the specific color and value of the adjacent horizontal striations. Thus, the present invention allows the use of transition stripes 122 and 124 to provide a subtle graduation or change in value between of the adjacent horizontal striations 22, 24 and 26.

Each horizontal striation 22, 24 and 26 along with the associated transition stripes 122 and 124, may be formed from mineral granules having the same generic color or tone, such as brown, gray, red, blue, yellow or black. Horizontal striations 22, 24 and 26 are preferably formed from the selected generic color having respective variations of the generic color with a light, medium and dark value. As noted above, a colorimeter or other suitable testing equipment may be used to measure the value of light or dark contrast associated with horizontal striations 22 and 26.

Generally, the greater the difference in contrast the more aesthetically appealing the resulting shingle. However, for some applications, a large difference in contrast or value between horizontal striations 22, 24 and 26 without an appropriate gradation in value between these striations will create a confused and disjointed appearance. The unpleasant appearance may be a striped or "zebra" effect. Therefore, an important feature of the present invention includes providing transition stripes 122 and 124 between the associated horizontal striations 22, 24 and 26.

The acceptable difference in contrast between horizontal striations 22 and 26 depends in part upon the generic color and tone selected for the specific laminated shingle 10. For example, the preferred contrast in value for some color tones may be as high as eighteen (18) while for other color tones, the contrast value may be eight (8) or nine (9).

The present invention includes the ability to vary the mixture of the ceramic coated mineral granules used to form transition stripes 122 and 124 to provide the desired subtle, gradual change in value between horizontal striations 22 and 26, while at the same time having a large value gradation. For a typical group of color tones, such as brown, gray, red, blue, yellow and black, an acceptable range of color contrast or value gradation may be from six (6) to eleven (11). By including transition stripes 122 and 124 between horizontal striations 22, 24 and 26, the acceptable range for the value gradation for the same family of colors may be increased from nine (9) to eighteen (18). Thus, the use of transition stripes in accordance with the teachings of the present inventions allows use of a higher value gradation for the same color tone.

Each tab 32 may have essentially the same uniform value and/or color or may be of a differing value and/or color. The present invention allows shingle 10 to have a weather surface 42 with enhanced value gradations represented by horizontal striations 22, 24 and 26 and their associated transition stripes 122 and 124 disposed between relatively uniform value portions represented by tabs 32.

As previously noted transition stripe 122 is preferably disposed between horizontal striations 22 and 24 and transition stripe 124 is preferably disposed between horizontal striations 24 and 26. For purposes of illustration only, horizontal striations 22, 24 and 26 are shown in FIG. 8A with solid lines 23 and 25 disposed respectively therebetween. Solid lines 23 and 25 are typically not present on the actual headlap 20. For one application, the nominal width of horizontal striations 22, 24 and 26, as shown in FIG. 8B, may be in the range of approximately 1.4 to 0.9 inches.

Transitions stripes 122 and 124, as best shown in FIG. 8B, are preferably disposed between respective horizontal striations 22, 24 and 26. For one application of the present invention, transition stripes 122 and 124 preferably have a width of approximately one inch. The centerline of transition stripe 122 will preferably correspond approximately with line 23 between horizontal striations 22 and 24. The centerline of transition stripe 124 will preferably correspond approximately with line 25 between horizontal striations 24 and 26. For purposes of illustration, only solid lines 121 and 123 are shown in FIG. 8B to more clearly identify transition stripe 122. In the same respect, solid lines 125 and 127 are shown in FIG. 8B to more clearly define transition stripe 124. In actual practice, solid lines 121, 123, 125 and 127 are typically not formed on the respective headlap 20.

Different colored mineral granules corresponding to the desired horizontal striations 22, 24 and 26 may be placed in the appropriate compartments 92, 94 and 96 for one embodiment of the present invention. As sheet 80 passes under hopper 90, mineral granules from the appropriate compartment in hopper 90 will fall onto top surface 82 of sheet 80. Roller 86 will then press the mineral granules into the associated asphalt coating. The volume or pounds per square foot of mineral granules placed on surface 82 is preferably the same throughout the full width of sheet 80. However, by dividing hopper bin 90 into compartments, the color and/or value of various portions of sheet 80 may be varied including providing horizontal striations 22, 24, and 26 and transition stripes 122 and 124 for headlap 20.

It is important to note that conventional procedures for fabricating shingles having an exterior surface formed by mineral granules include the use of granule blenders and color mixers, along with sophisticated equipment to ensure a constant uniform color drop at each location on the exposed portions of the shingles. Extensive procedures are used to ensure that each color drop on a sheet of roofing material is uniform. The color drop between shingles may be varied to provide different shades or tones in color. However, within each color drop, concerted efforts have traditionally been made to insure uniformity of the color on the resulting shingle associated with each color drop.

As shown by dotted line 84 in FIG. 8A, sheet 80 may be cut into two horizontal lengths or lanes. The width of the lanes is selected to correspond generally with the desired width for single layer sheet 10. The lanes may then be cut laterally to correspond with the desired length for the resulting single layer shingle sheet 10. The rotation of roller 86 and the movement of sheet 80 are coordinated to place the desired color drop or drops on each single layer shingle 10.

The cut along dotted line 84 corresponds with the desired pattern for dragon teeth 32 and associated openings 34. For some applications, six lanes may be cut from a sheet of roofing material similar to sheet 80. The number of lanes is dependent upon the width of the respective sheet of roofing material and the desired width of the resulting shingles.

As shown in FIG. 9A, each lateral cut of sheet 80 will typically result in two single layer shingle sheets 10. The single layer shingles 10 are then packaged with the desired color configuration for future installation on a roof.

Figure 11:
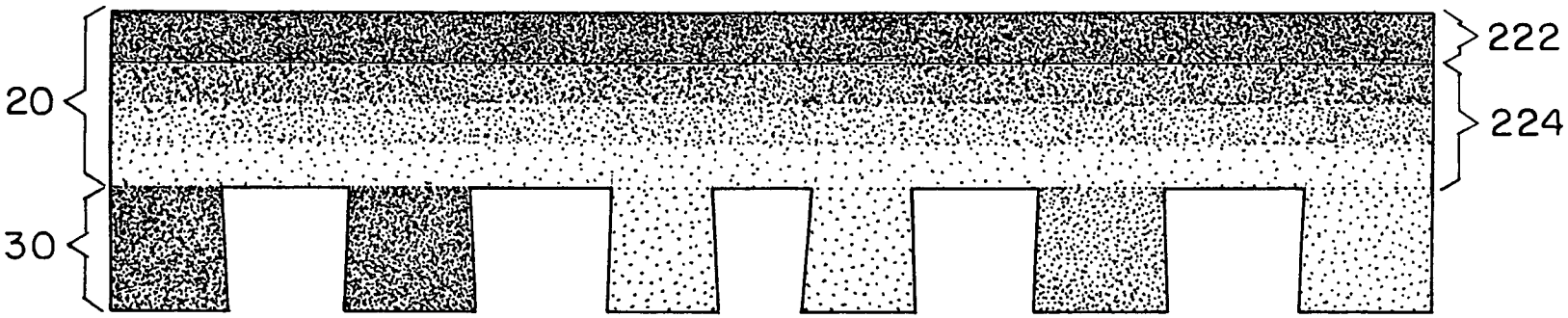
FIG. 11 shows an exemplary embodiment of a single layer shingle of the present invention wherein the headlap comprises an exposure zone and a non-exposure zone.

In another embodiment of the invention, as shown in FIG. 11, the single layer shingle of the invention comprises a tab portion 30 and a headlap portion 20, wherein the headlap portion further comprises an exposure zone 224 and a non-exposure zone 222. In this embodiment, the headlap portion has a greater width than the tab portion. Accordingly, when the single layer shingle is installed on a roof deck, the tab portion 30 of an overlying shingle, partially covers the exposure zone 224. In addition, the headlap portion of the overlying shingle completely covers the non-exposure zone.

In accordance with the invention, the exposure zone 224 comprises a color gradient thereon which is preferably comprised of a plurality of horizontal striations. The non-exposure zone 222 may be covered with roofing granules in any manner known in the art. In a particularly preferred embodiment, the width of the headlap portion is approximately 2 inches greater than the width of the tab portion. For example, the single layer shingle of the invention may be 12 inches wide having a tab portion 30 that is 5 inches wide and a headlap portion 20 that is 7 inches wide, wherein the exposure zone 224 of the headlap portion is 5 inches wide and the non-exposure zone 222 of the headlap portion is 2 inches wide.

Because the roofing material of the present invention can be made from a single sheet of roofing material, i.e. not a composite or a laminated shingle, the roofing material of the present invention has several advantages, such as ease of manufacturing, packaging, and installing. The roofing material may also be less costly to manufacture and transport than laminated shingles that seek to achieve the same visual result. The single layer roofing material of the present invention may also be manufactured in the form of roll roofing, which further improves the advantages indicated above.

In one embodiment, the roofing material of the present invention is manufactured as roll roofing (i.e. a continuous sheet) with a self-adhesive backing for ease of installation on a roof deck or other surface. A protective membrane or release paper may be included that covers the self-adhesive coating. This membrane may be removed during installation to provide a peel and stick roofing product. The self-adhesive backing may be any type of material that can act as a water barrier, such as asphalt, preferably an aggressive asphalt sealant. Examples of asphalt that can be used include oxidized, unoxidized, rubberized, filled and unfilled, virtually any asphaltic compound which can be coated, mopped or sprayed and can act as an adhesive. One example of adhesive asphalt is peel-and-stick asphalt, also known as ice and snow shield, which is sold by numerous manufacturers including Koppers Industries, GAF Materials Corp., and G. S. Roofing. Peel-and-stick asphalt is traditionally a styrene-butadiene-styrene ("SBS") modified very low viscosity asphalt that is typically employed with a release paper on one side of the asphalt.

In one embodiment, the self-adhesive backing may be applied to the entire underside of the roofing material of the present invention. In another embodiment, the self-adhesive backing may be applied to only a portion of the underside of the roofing material of the invention. Preferably, the self-adhesive backing is applied at least to the tab portion of the shingle. In a particularly preferred embodiment, the self-adhesive backing is applied to the tab portion and to part of the headlap portion above the tab portion. For example, the self-adhesive backing may be applied to the tab portion and to a continuous horizontal band of approximately one inch on the headlap portion adjacent to the tab portion on the headlap portion.

In one embodiment, the single layer roofing material is applied to a roof deck by nailing one end of the material to the roof deck, rolling the material out so that it is flat, aligning the material as desired, placing a few nails on the headlap to keep the material in the desired place, removing the release paper from the back of the roofing material, and sealing the roofing material to the roof deck via the self-adhesive backing.

The thickness of the single layer roofing material of the present invention may be enhanced by adding additional webs or membranes to the roofing material. For example, after a roll of membrane has passed under the granule hopper, as described above for FIGS. 6 and 8, but before it has been cut, an underlying layer or web may be adhered to the back. The underlying layer or web may be covered with fines or other backing material, and it may additionally or alternatively be covered with roofing granules. A standard laminating adhesive may be used to adhere the underlying layer to the back of the roofing material. Once the underlying layer has been adhered, the composite material may be cut to provide a shingle having tabs and openings. Any number of underlying layers may be added to provide the desired thickness. In a preferred embodiment, the underlying layers create a thickness that is approximately 2 to 3 times the thickness of the single layer roofing material of the invention. The entire roofing material may be provided with underlying layers, or alternatively, only the tab portion may be made thicker by including underlying layers only at the tab portion. U.S. Pat. No. 6,679,020, incorporated herein by reference in its entirety, describes shingles having underlying layers wherein the underlying layers are included only in the tab portion of the shingle.

In one embodiment, the roofing material of the invention may have an exposure such as that described in U.S. patent application Ser. No. 10/212,012, incorporated herein by reference in its entirety.

Although the present invention and its advantages have been described in detail, it should be understood that various changes, substitutions and alterations can be made therein without departing from the spirit and scope of the invention as defined by the appended claims.

What is claimed is:

1. A single layer roofing material comprising:

a headlap portion comprising a leading edge and an upper edge, the headlap portion having a layer of colored mineral granules disposed thereon, wherein said headlap portion has at least first, second, and third horizontal rectangular striations of said colored mineral granules providing a color value gradation across said headlap starting at about the leading edge and proceeding continuously through said headlap, ending at about the upper edge, and wherein each of said at least first, second, and third striations has a distinct color value substantially uniform throughout, and wherein the color value gradation is from light starting at the leading edge to dark at the upper edge; and a tab portion comprising at least first, second and third tabs extending from said leading edge of said headlap portion, said at least first, second and third tabs spaced apart to define a plurality of openings between said tabs, wherein a layer of colored mineral granules is disposed on said tabs providing different color values on each of at least three of said tabs, and wherein a portion of the granules disposed on said at least three tabs has a color value substantially similar to the color value of at least a portion of the granules providing the color value gradation across said headlap.

2. The roofing material according to claim 1, wherein the color of said mineral granules on said tabs is relatively uniform throughout each tab.

3. The roofing material according to claim 1, wherein the color of said mineral granules on one tab differ from the color of mineral granules on another tab.

4. The roofing material according to claim 1, wherein the tabs and openings are of unequal size and shape.

5. The roofing material according to claim 1, wherein the horizontal striations further comprise one striation having a lighter color value and an adjacent striation having a darker color value to establish the color value gradation.

6. The roofing material according to claim 1, wherein said horizontal rectangular striations have a different color value as compared to an adjacent striation; and a transition stripe disposed between each pair of adjacent striations to provide a portion of the color value gradation, wherein each transition stripe has a color value comprising a mixture of the respective colored granules associated with the horizontal striations disposed on either side of each transition stripe.

7. The roofing material according to claim 6, wherein each transition stripe has an approximately equal mixture of the respective colored granules of the horizontal striation disposed on either side of each transition stripe to establish the color value gradation.

8. The roofing material according to claim 1, wherein the roofing material is a roofing shingle.

9. The roofing material according to claim 1, wherein the roofing material is roll roofing.

10. The roofing material according to claim 1 further comprising a self-adhesive backing material.

11. The roofing material according claim 10, wherein the self-adhesive backing further comprises a covering.

12. The roofing material according to claim 11, wherein the covering is selected from the group consisting of a release paper and a release film.

13. The roofing material according to claim 1, wherein the headlap portion further comprises an exposure zone and a non-exposure zone.

14. The roofing material according to claim 1, wherein said headlap portion has, in addition to said at least first, second and third horizontal rectangular striations, a plurality of additional horizontal rectangular striations of said colored mineral granules.

* * * * *